US007193561B2

(12) United States Patent
Mehltretter

(10) Patent No.: US 7,193,561 B2
(45) Date of Patent: Mar. 20, 2007

(54) PHASE CONTROLLED ANTENNAE FOR DATA TRANSMISSION BETWEEN MOBILE DEVICES

(75) Inventor: Ludwig Mehltretter, Riemerling (DE)

(73) Assignee: EADS Deutschland GmbH, Ottobrunn (DE)

( * ) Notice: Subject to any disclaimer, the term of this patent is extended or adjusted under 35 U.S.C. 154(b) by 340 days.

(21) Appl. No.: 10/902,275

(22) Filed: Jul. 30, 2004

(65) Prior Publication Data

US 2005/0052330 A1 Mar. 10, 2005

(30) Foreign Application Priority Data

Aug. 1, 2003 (DE) ..... 103 35 216

(51) Int. Cl.
*H01Q 9/16* (2006.01)

(52) U.S. Cl. ..... 342/372; 342/448

(58) Field of Classification Search ..... 342/368, 342/372, 434, 446, 448; 343/705, 820
See application file for complete search history.

(56) References Cited

U.S. PATENT DOCUMENTS 3,560,978 A 2/1971 Himmel et al.
3,950,753 A * 4/1976 Chisholm ..... 342/399
4,656,482 A 4/1987 Peng
2002/0186170 A1 12/2002 Ceccom et al.
2003/0071758 A1 4/2003 Bien et al.
2003/0156061 A1* 8/2003 Ohira ..... 342/372
2004/0196184 A1* 10/2004 Hollander et al. ..... 342/418
2004/0201513 A1* 10/2004 Klausing et al. ..... 342/25 A
2005/0212714 A1* 9/2005 Chiang et al. ..... 343/810
2006/0087475 A1* 4/2006 Struckman ..... 342/451

FOREIGN PATENT DOCUMENTS

DE 1953443 5/1970

* cited by examiner

*Primary Examiner*—Dao Phan
(74) *Attorney, Agent, or Firm*—Crowell & Moring LLP

(57) ABSTRACT

In a phase-controlled antenna array for mobile devices, in particular designed for flying device, groups of controllable passive antenna elements are arranged in concentric circles around an active central antenna element. The arrangement of additional similar planar antenna arrays among the original antenna array is especially advantageous with regard to bundling the emission characteristic.

8 Claims, 4 Drawing Sheets

PHASE CONTROLLED ANTENNAE FOR DATA TRANSMISSION BETWEEN MOBILE DEVICES

BACKGROUND AND SUMMARY OF THE INVENTION

This application claims the priority of German Patent Application 103 35 216.3, filed Aug. 1, 2003, the disclosure of which is expressly incorporated by reference herein.

This invention relates to a phase-controlled antenna comprising a plurality of antenna elements situated in the area of the surface of a mobile device.

Trackable bundled antennas are required for transmission of large data volumes over great distances between unmanned flying devices, airplanes, motor vehicles and stationary stations. These antennas can automatically align themselves with the remote station in accordance with the rate of propagation of the respective device.

The use of mechanically pivotable or phase-controlled directional antennas, usually covered with large radomes, is possible only to a limited extent because of the considerable amount of space required, e.g., in compact flying devices. Essentially antennas in a stationary installation are preferred in comparison with mechanically movable antennas in mobile devices because of their lower sensitivity to high mechanical loads. Therefore, there has been increased development of phase-controlled antennas whose directional effect is variable without mechanical drives and which therefore can be positioned much more rapidly in the new direction. However, phase-controlled directional antennas are very complex because of the large number of component antennas required and because each component antenna must be triggered in a phase-controlled and amplitude controlled manner.

Phased-array antennas are generally known. U.S. Pat. No. 4,656,482 A1 describes a phased-array antenna that can be installed in the wing of a flying device. This antenna is designed for the same intended application but it requires a great complexity of components for controlling the individual active antenna elements because of the many antenna components which must be triggered in a phase-controlled and amplitude-controlled procedure. This type of antenna has an extremely broad band but controlled adjustability of the directional effect is limited, particularly in the elevation direction. Finally, a substantial extent is necessary in the base plane to generate the directional effect.

The object of this invention is therefore to design a phase-controlled antenna for installation in the area of an exterior surface of a mobile device, preferably a flying device, which avoids the aforementioned disadvantages of the known prior art, is characterized by a simplified design and electric control and can be designed to be more compact with regard to the planar extent without any restriction on the electric specifications.

In addition to the easy integrability into existing structures of mobile devices, the special advantage of the inventive phase-controlled antenna is also the small amount of space required in the plane in which the antenna elements are arranged. It is advantageous that only a small number of individual antenna elements is needed in a plane in comparison with the prior art. In addition, it is advantageous that two or more planes having a similar arrangement of antenna elements one above the other produce an additional improvement in the directional effect and thus increase the antenna gain in the elevation direction. With high-frequency signals it is advantageous that only the central active antenna element receives signals, whereas the alignment in the elevation direction and in the azimuthal direction is accomplished exclusively by control signals with the help of which the electrically active length of the passive antenna elements is varied. This eliminates the complex networks which are necessary in the conventional prior art for supplying signals in the correct phase sequence to individual antenna elements.

If the antenna is used for reception, it is advantageous that the efficiency of the antenna is high because there are no distribution networks or phase shifter networks whose losses would reduce the efficiency.

The individual antenna elements may optionally be designed as monopoles or dipoles in suitable embodiments. The coupling may be influenced through a suitable choice of the respective transverse dimension, i.e., the diameter of the antenna element and/or through the choice of the distance between the individual antenna elements, depending on the type of design.

The controlled adjustment of the phase effect of the individual passive antenna elements is accomplished easily by connecting or disconnecting and/or bridging the passive components (such as capacitors or inductors), by connecting or disconnecting controllable components (such as variable capacitance diodes or variometers) and by connecting lines. Control of the controllable components may be accomplished by analog or digital means using D/A converters.

To improve the directional effect in the elevation direction, two or more planes with the same groups of active and passive antenna elements are advantageously arranged one above the other with a distance of at least one-third of the operating wavelength being maintained between the ends of the antenna elements of different levels. The antenna diagram of the overall arrangement of the phase-controlled antennas in the elevation direction is advantageously accomplished by individual control of each plane with regard to the absolute value and phase of the signal. The distance between two levels should amount to at least ¾λ of the operating wavelength.

A phase-controlled antenna of the inventive design is very suitable for integration into the area of the contour of a mobile device, especially naturally for installation in aerodynamically active surfaces such as the wings, the horizontal stabilizer or the flaps of a flying device. It can be installed equally well in an aerodynamically shaped housing which is mounted at a certain distance from the contour of the actual flying device with the help of a stanchion. The maximum range of the usable directions for reception and emission of signals will then also vary, depending on the installation site.

The phase-controlled antenna may also be installed in the wing tip of a flying device, where the wing tips are pivotably mounted on the wing for pivoting about an axis aligned in the direction of flight so that the respective wing tip is always approximately in the horizontal during the flight.

Finally, an especially advantageous design of the antenna array is proposed in which additional strip-shaped plates which contain the antenna elements and the components required for controlling them are arranged perpendicular to a base plane, which may also be designed in multiple layers and may have multiple conductors or conducting surfaces.

Because of the compact dimensions, the radar localizability of the antenna is also reduced. Thus in the case of flying devices, defensive measures (e.g., flare jammers) against threats from the ground may also be greatly reduced. Furthermore, the localizability from the ground is reduced because signals are emitted only in the direction of the remote station. Because of the good bundling in the azimuth and elevation, the localizability from the ground is reduced because of the lower required transmission power, and because signals are emitted only in the direction of the remote station. This reduces the electric power to be supplied.

Other objects, advantages and novel features of the present invention will become apparent from the following detailed description of the invention when considered in conjunction with the accompanying drawings.

BRIEF DESCRIPTION OF THE DRAWINGS

A simplified exemplary embodiment is illustrated schematically in the drawing and described in greater detail below.

DETAILED DESCRIPTION

Figure 1:
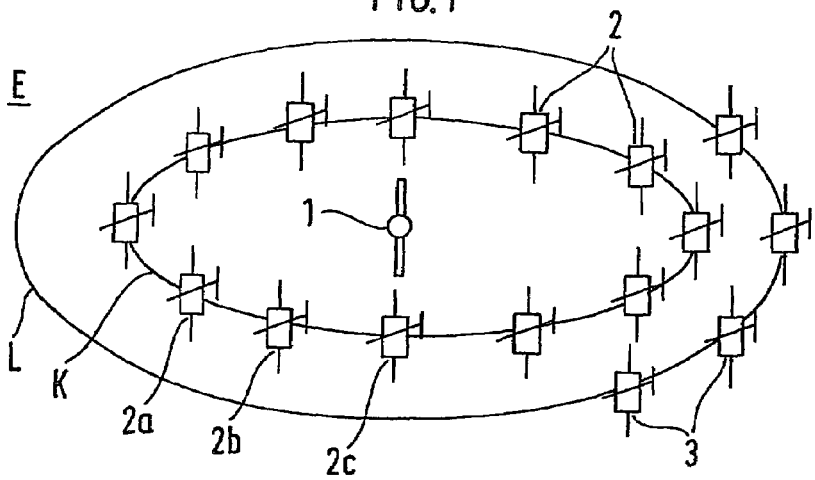
FIG. 1 illustrates the inventive phase-controlled antenna with an arrangement in one plane.

FIG. 1 illustrates an inventive phase-controlled antenna which is arranged in a plane spanned by the circles K and L and which extends approximately parallel to the longitudinal axis of a mobile device (which is not shown in greater detail here), in particular a flying device. The term longitudinal axis as used here is understood to refer to the main direction of movement of the respective device. Thus the plane E may be aligned preferably approximately horizontally or even vertically as well as in any intermediate position between the aforementioned positions.

A group of passive antenna elements 2, 2*a*, . . . , 2*c* is placed at least on an imaginary circle K around a centrally arranged active antenna element 1. The radius of the imaginary circle is a multiple n of a quarter of the operating wavelength λ where n=1, 2, 3, . . . The group may be designed so that it includes a small number of antenna elements 2*a*, 2*b*, 2*c* arranged with a distance between them (forming a "group" in the narrower sense). It may also include the antenna elements 2, which are arranged with a distance between them and are uniformly distributed around the active antenna element 1.

A definite improvement of the bundling of the phase-controlled antenna is obtained by arranging additional antenna elements 3 as a group in the sense described above on at least one other circle L which is on the outside. The radius of the next outer circle is then approximately 0.2 . . . 0.3×the operating wavelength λ greater than the radius of the next circle toward the interior.

Figure 2A:
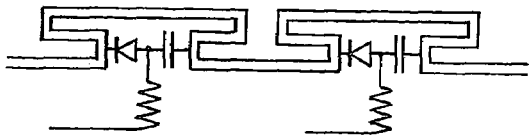
FIGS. 2*a*–2*c* illustrate various embodiments of components for changing the electrically active length of an antenna element.
Figure 2B:
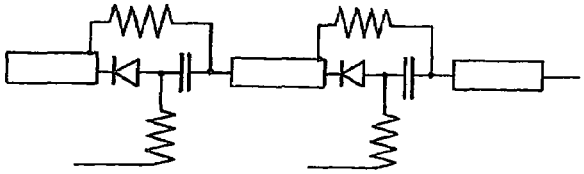
Figure 2C:
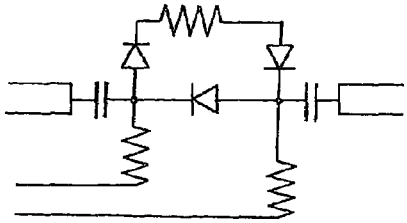

The usual monopoles or dipoles are used as the antenna elements 2, 2*a*, . . . , 3, whereby the passive antenna elements are equipped with phase shifting components such as capacitors or inductors which can be connected or disconnected in a controlled manner. A continuous change in capacitance by means of variable capacitance diodes or a change in inductance by using variometers is also possible with the same effect. Examples a, b and c here are illustrated in FIGS. 2*a*–2*c*. Bypassing lines and coils, to which diodes that can be connected or disconnected, are added in parallel or serially in a suitable manner and are used to vary the electrically active length of the particular antenna element.

Figure 2D:
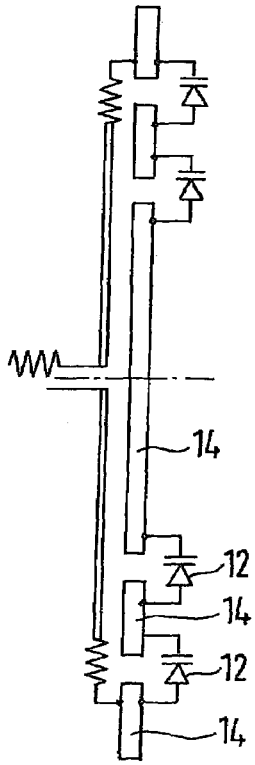
FIG. 2*d* illustrates an antenna element with integrated components for varying its electrically active length.

FIG. 2*d* illustrates an exemplary embodiment of the antenna arrangement with a circuit for the purpose of influencing the electrically active length of the antenna element in which variable capacitance diodes are used as controllable electronic components. In addition, a continuous variation in capacitance or inductance is also possible by using variable capacitance diodes or variometers. A mechanical change in the length of each passive antenna element is likewise readily possible.

In the concrete application, the respective phase relation of each passive antenna 2, 2*a*, . . . , 3 is thus achieved by varying its electrically active length to change the direction of emission. The phase-variable elements are triggered by control signals and not by high-frequency signals, the guidance of which requires special measures.

The passive antenna elements 2, 2*a*, . . . , 3 are energized via the mutual coupling. Therefore, the level becomes progressively smaller from the inside toward the outside. This is advantageous only with regard to the suppression of the secondary lobes in the radiation diagram (tapering) as mentioned above. The intensity of the coupling can be influenced in a certain bandwidth by means of a suitable choice of the transverse dimension and/or thickness. The mutual fitting of the mutual spacing of the passive antenna elements 2, 2*a*, . . . 3 changes the degree of the mutual coupling.

The inventive antenna array having a Yagi antenna is functionally comparable and has a similarly improved directional effect in the horizontal. Furthermore, pivoting of the antenna diagram in the horizontal is possible without any loss of gain. As with the Yagi antenna, there is a limited bundling in the elevation direction.

For this reason, it is recommended according to this invention that at least one additional group of antenna elements should be arranged above or below the existing group as described here. The distance from dipole tip to dipole tip should amount to at least one-third of the operating wavelength. The signals are supplied to the central antenna elements and the passive antenna elements are controlled with regard to the phase relation in this group or the other groups in the same way as described above. The antenna diagram of the overall arrangement of the phase-controlled antenna in the elevation is influenced with regard to absolute value and phase by means of individual control of the respective plane. Thus, on the one hand, the gain in the elevation direction may be increased, while on the other hand the beam direction in the elevation direction can be tracked in a certain range. As a rule, the required mounting depth is achieved with all conventional mounting sites.

The actual size of the inventive antenna array depends on the selected operating frequency. For example, for an antenna with bundling in the horizontal of approximately 30 dB, this yields a diameter on the order of 30 cm to 40 cm at an operating frequency of 10 GHz. The antenna according to this invention can be operated in a wide frequency range, such as the range from 1 to 100 GHz. Due to dimension requirements of some applications, the range around 18 GHz may be found to be ideal. This frequency is also especially favorable with regard to the propagation conditions.

The inventive antenna array is very suitable for integration into various installation sites in or on moving devices because of its compact design. These devices include manned or unmanned wheeled vehicles, or track-laying vehicles. These vehicles can easily be equipped with an inventive antenna array in the area of the lateral or upper exterior surfaces of the body. This is also true for use in the area of built-on accessories of ships.

However, the antenna array is also advantageously suitable for installation into aerodynamic absorption surfaces of manned or unmanned flying devices. Because of the small transverse dimensions, there is no problem with installation into the wings. Since there must be a certain distance from the outside edges, their influence on the emission characteristic can be disregarded. The required depth for installation of an antenna array having two or more levels is not usually a problem in a wing.

The inventive antenna array is especially suitable for installation into thin aerodynamically active surfaces such as ruder units and horizontal tail units as well as in canard wings. In the simplest case, a plane E, in which the antenna elements 1, 2,. . . , 3 are arranged, forms the plane of symmetry for the aerodynamic active surface. If several similar planes of antenna arrays are used, their middle plane coincides with the plane of symmetry. In the case of thin profiled aerodynamic active surfaces, this is true in first approximation.

Figure 3:
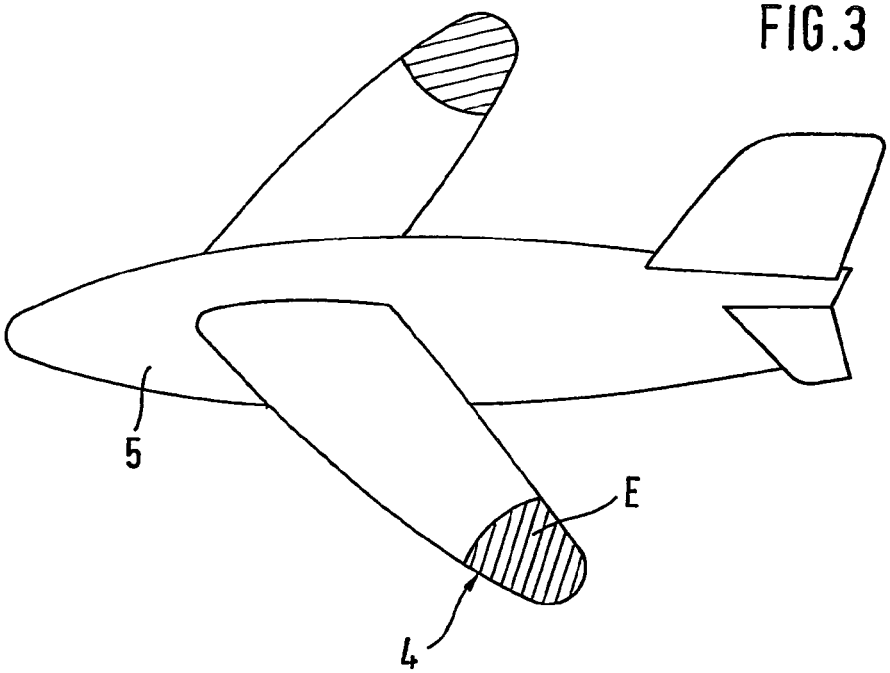
FIG. 3 illustrates the arrangement of the phase-controlled antenna in the area of the ends of the wings of a flying device.

FIG. 3 illustrates an installation for which the inventive antenna is very suitable because of its geometric extent, namely the wing tips of a manned or unmanned flying device 5. The plane E extends here approximately in the middle plane of the wing profile.

Figure 4A:
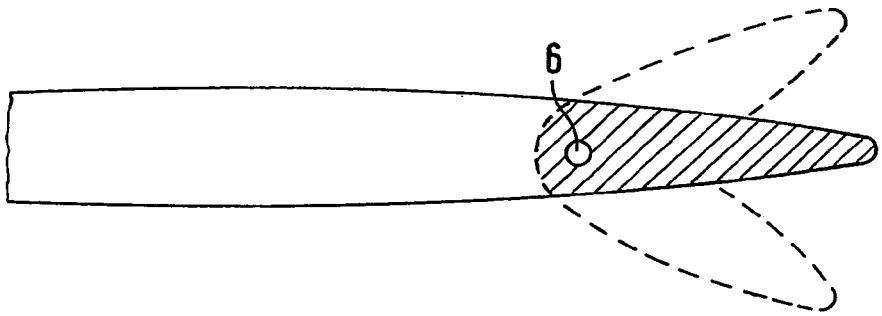
FIG. 4*a* illustrates an antenna arrangement in a pivotable wing tip.
Figure 4B:
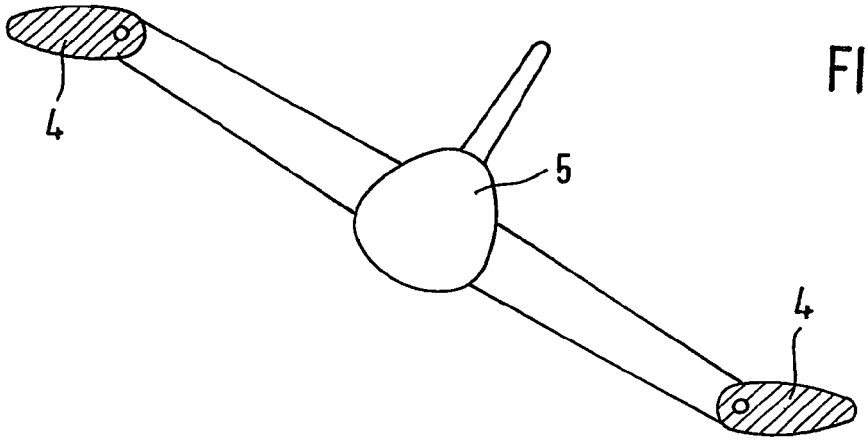
FIG. 4*b* illustrates the pivoting of the wing tips during a flight.

The diagram in FIG. 4*a* illustrates a detailed embodiment in this regard. The wing tip 4 which contains the entire antenna array, is mounted so it can rotate about a pivot axis 6 running approximately in the middle plane in the direction of flight. The diagram in FIG. 4*b* illustrates schematically how the wing tips 4 can be pivoted with the help of a suitable drive with an inclined flight position of the flying device 5 so that the plane E of the antenna array is always approximately in the horizontal.

Figure 5:
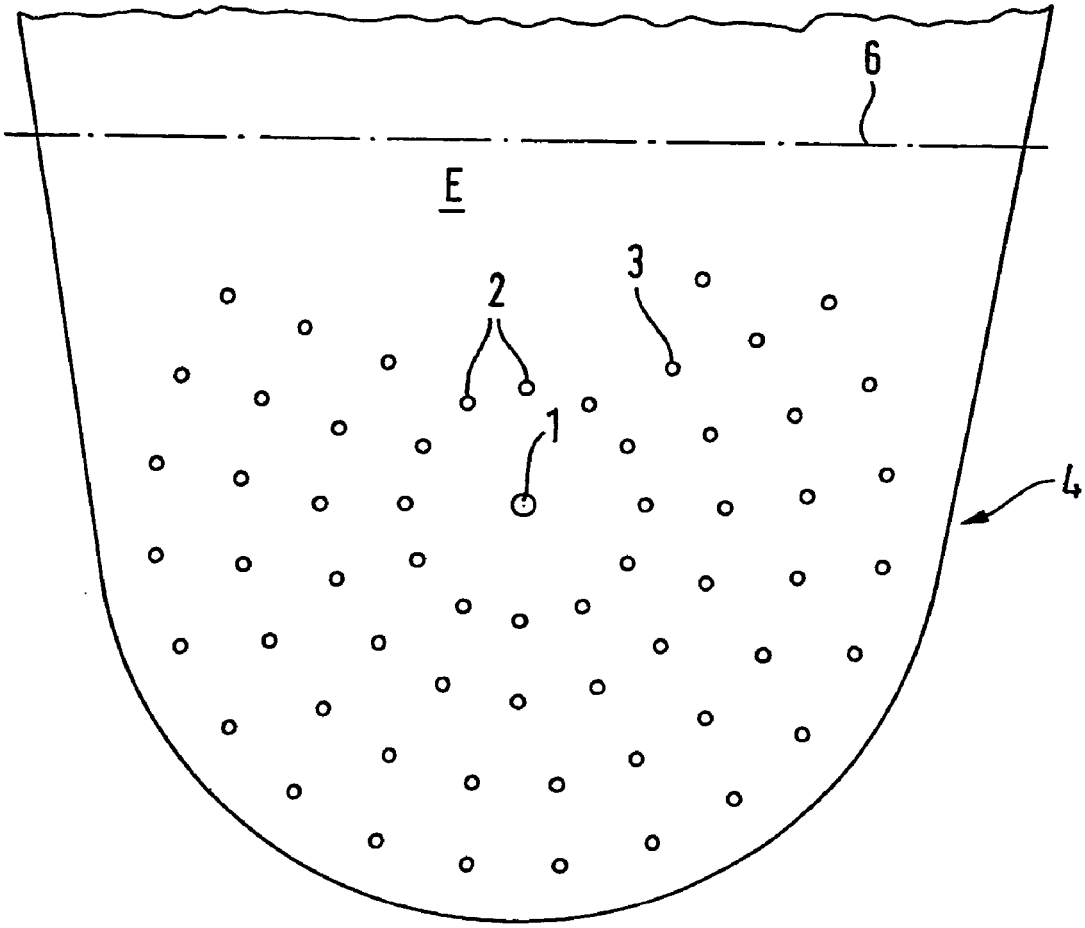
FIG. 5 illustrates the arrangement of a phase-controlled antenna within a wing tip.

Thus in the case of installation in the wing tips 4, one antenna covers each half of the azimuth range. Therefore the number of passive antenna elements 2, 2*a*, . . . , 3 in this design, illustrated in the view from above in FIG. 5, may be reduced on the side facing the body of the flying device. The antenna arrays in the two wing tips are thus mutually complementary in covering the entire azimuth range. It is also conceivable for the pivotable part of the antenna array to be covered with a radome.

The proposed antenna array is implemented in an inexpensive and expedient manner in a plate 7 comprising one or more layers essentially comprising an insulating carrier material and also containing all the required feeder lines 15 to the active and passive antenna elements 1, 2, 3, as well as the fastening devices. In addition, a ground surface (not shown in detail in the diagram) is provided as the reference potential in a suitable layer, preferably on the underside of the plate 7; this is absolutely essential in particular when using monopoles.

The passive antenna elements 2, . . . , 3 are arranged on concentric circles K, L, M and are electrically connected to the feeder lines on the plate 7. For example, recesses A may be formed in the plate 7 at locations where a passive antenna element 2,. . . , 3 is arranged; the purpose of these recesses will be explained below in conjunction with FIG. 7.

Figure 6A:
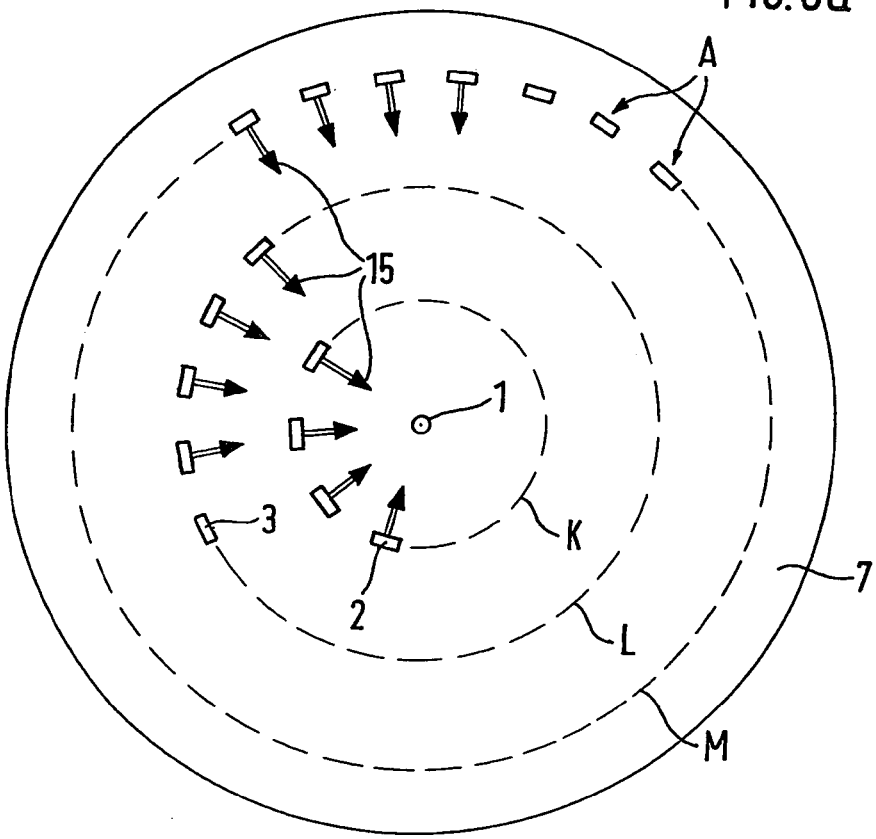
FIG. 6*a* illustrates a top view of the base plate of an advantageous embodiment of this invention.
Figure 6B:
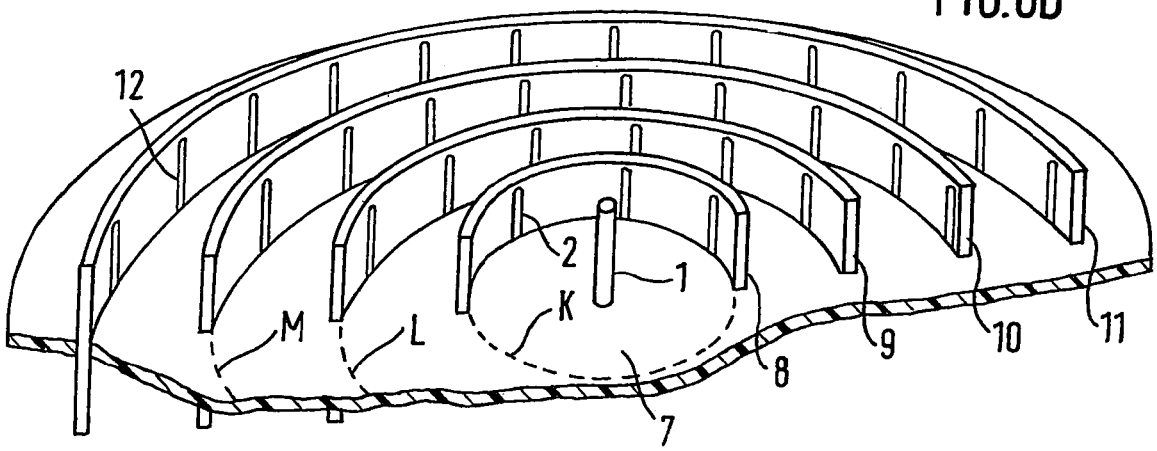
FIG. 6*b* illustrates an inclined view of the base plate with strip-shaped plates arranged on it, containing the passive antenna elements.

FIG. 6*b* illustrates an embodiment for arranging the required passive elements 2, . . . , 3 on concentric circles K, L, M around the active antenna element 1. Accordingly, the passive antenna elements 2, . . . , 3 are mounted on strip-shaped plates 8, . . . , 11 or they are designed by means of conventional manufacturing methods. The strip-shaped plates have electrically conducting strips or areas arranged on an insulating carrier material, serving to provide the electrical connection for components 12 but also being used to produce the antenna elements themselves or parts thereof. The electric components 12 which are needed for actively changing the electric length of a passive antenna element are preferably also arranged on the strip-shaped plates.

Figure 7:
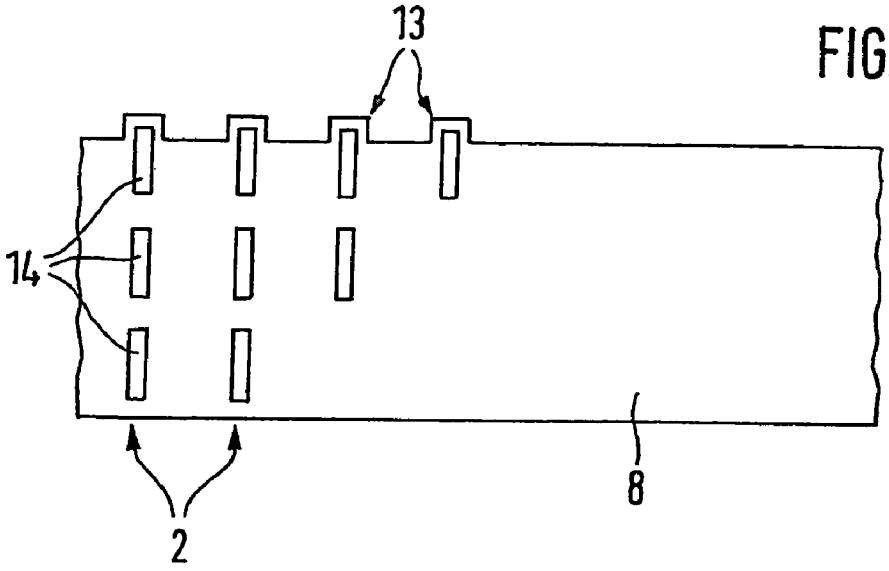
FIG. 7 illustrates exemplary embodiments of strip-shaped plate with passive antenna elements.

FIG. 7 illustrates a side view of a strip-shaped plate 8, . . . , 11, which was described above in connection with FIG. 6*b*. Projections 13 with an approximately rectangular cross section can be seen at the top edge in the area of the passive antenna elements 2. These are inserted into the recesses A in the base plate 7 shown in FIG. 6*a* in assembling the entire antenna array 7, 8, . . . 11, thus yielding a form-fitting transition between the two plates involved. Similar connecting options between the base plate and the strip-shaped plate(s) can be used equally well. In addition, the positioning of the individual antenna elements 2 on the strip-shaped plate 8 is also indicated here. In this exemplary embodiment (see FIG. 2*d*) the component elements 14 of the respective element 2, which cannot be varied electrically, are designed as printed conductors, whereby the clearances remaining between the components are used for the assembly of the components 12 which determine the electrically active length.

Finally, the antenna array is very suitable for installation in housings which are installed outside of the contour of mobile devices in such a way that the reference plane E runs approximately parallel to the longitudinal axis of the mobile device. When using flying devices, this housing is designed to be aerodynamically favorable.

In addition this invention also relates to the use of an inventive antenna array as described above on a mobile device, in particular a manned or unmanned flying device.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Phase-controlled antenna comprising a plurality of antenna elements arranged in the area of a surface of a mobile device, wherein the phase-controlled antenna is arranged in at least one plane approximately parallel to a longitudinal axis of the mobile device, a plurality of passive antenna elements are uniformly distributed around an active antenna element on peripheral circles each with a radius which is approximately a multiple of $\frac{1}{4}\cdot\lambda$ and perpendicular to the plane and/or being arranged as a group, wherein $\lambda$ is operating wavelength, wherein the mobile device is a flying device and an antenna array comprising the active and the plurality of passive antenna elements is arranged in an area of wing tips of the flying device, and wherein a part of a wing which includes the antenna array is mounted so that it is pivotable in elevation about an axis arranged in a direction of flight.

2. Phase-controlled antenna as claimed in claim 1, wherein an antenna array comprises groups of active and passive antenna elements arranged in several parallel planes one above the other.

3. Phase-controlled antenna as claimed in claim 2, wherein an antenna diagram of the antenna array of the phase-controlled antenna is aligned in elevation by means of individual control of the respective plane with respect to the absolute value and phase.

4. Phase-controlled antenna as claimed in claim 2, wherein a distance between the planes is at least three-quarters of the operating wavelength λ.

5. Phase-controlled antenna as claimed in claim 1, wherein pivoting is performed as a function of a position of the flying device in such a way that a respective part of the wing is in a horizontal.

6. Phase-controlled antenna as claimed in claim 1, wherein installation of the antenna includes a base plate having a plurality of planes which have conductors or areas on which additional strip-shaped plates are arranged perpendicular to the base plate in a circular arrangement, whereby the strip plates contain the passive antenna elements and the components required for controlling them.

7. A method of using a phase-controlled antenna in a flying device, which comprises a plurality of antenna elements and which is arranged in at least one plane approximately parallel to a longitudinal axis of the flying device, the plurality of passive antenna elements are uniformly distributed on peripheral circles with a radius which is approximately a multiple of ¼·λ around the active antenna element so that they are perpendicular to the respective plane and/or are arranged as a group, wherein λ is the operating wavelength, wherein the method comprises the acts of:

arranging the phase-controlled antenna in an area of wine tips of the flying device; and pivoting the wing tips as a function of a position of the flying device in such a way that a respective part of the wing is in a horizontal.

8. A flying device comprising:

a wing, including a wing portion pivotable in elevation about an axis arranged in a direction of flight; and a phase-controlled antenna comprising a plurality of antenna elements, the phase-controlled antenna is arranged in at least one plane approximately parallel to a longitudinal axis of the mobile device, a plurality of passive antenna elements are uniformly distributed around an active antenna element on peripheral circles each with a radius which is approximately a multiple of ¼·λ and perpendicular to the plane and/or being arranged as a group, wherein λ is operating wavelength, wherein the phase-controlled antenna is mounted on the wing portion that is pivotable.

* * * * *